US011761227B2

(12) United States Patent
Ritchie

(10) Patent No.: US 11,761,227 B2
(45) Date of Patent: Sep. 19, 2023

(54) TENT WITH CONFIGURABLE FLUE OPENINGS

(71) Applicant: The Cashmere Caveman Co, Wild Kitchens Limited, London (GB)

(72) Inventor: Guy Stuart Ritchie, London (GB)

(73) Assignee: The Cashmere Caveman Co, Wild Kitchens Limited, London (GB)

( * ) Notice: Subject to any disclaimer, the term of this patent is extended or adjusted under 35 U.S.C. 154(b) by 0 days.

(21) Appl. No.: 17/463,006

(22) Filed: Aug. 31, 2021

(65) Prior Publication Data

US 2023/0061764 A1 Mar. 2, 2023

(51) Int. Cl.
*E04H 15/16* (2006.01)

(52) U.S. Cl.
CPC ..... *E04H 15/16* (2013.01)

(58) Field of Classification Search
CPC ..... E04H 15/16; E04H 15/14
See application file for complete search history.

(56) References Cited

U.S. PATENT DOCUMENTS

| | | | | |
|---|---|---|---|---|
| 215,610 | A * | 5/1879 | Hobbs | E04H 15/14 135/93 |
| 386,563 | A * | 7/1888 | Steele | E04H 15/24 135/92 |
| 618,906 | A | 2/1899 | Reimer | |
| 632,818 | A * | 9/1899 | Linch | F16L 5/00 135/92 |
| 1,100,189 | A * | 6/1914 | Lockwood | E04B 7/026 52/63 |
| 1,213,022 | A * | 1/1917 | Rossi | E04D 13/1476 454/44 |
| 2,690,185 | A * | 9/1954 | Pomykala | E04B 1/3211 52/298 |
| 4,024,803 | A * | 5/1977 | Linecker | E04B 1/74 454/231 |
| 4,844,108 | A * | 7/1989 | Rohrer | E04H 15/26 135/92 |
| 11,051,655 | B2 | 7/2021 | Ritchie et al. | |
| 2011/0198044 | A1 | 8/2011 | Lin | |
| 2023/0065753 | A1 | 3/2023 | Ritchie et al. | |

FOREIGN PATENT DOCUMENTS

| | | | |
|---|---|---|---|
| CN | 209523524 | U | 10/2019 |
| GB | 2457088 | A | 8/2009 |
| IT | BO20100296 | T | 11/2011 |
| JP | S60-15595 | U | 2/1985 |

(Continued)

OTHER PUBLICATIONS

Extended European Search Report dated Jan. 17, 2023, directed to EP Application No. 22192248.7; 7 pages.

(Continued)

*Primary Examiner* — Noah Chandler Hawk
(74) *Attorney, Agent, or Firm* — MORRISON & FOERSTER LLP

(57) ABSTRACT

Roof beams or ridges having configurable vent or flue openings therein are disclosed. Such members may be used in tents or other temporary structures to allow for versatility in positioning stoves, heaters, or other apparatuses requiring exterior venting therein.

18 Claims, 9 Drawing Sheets

(56) References Cited

FOREIGN PATENT DOCUMENTS

WO 2019/125169 A1 6/2019

OTHER PUBLICATIONS

Extended European Search Report dated Jan. 30, 2023, directed to EP Application No. 22192247.9; 7 pages.
International Search Report and Written Opinion dated Jan. 12, 2023, directed to International Application No. PCT/IB2022/000481; 10 pages.
International Search Report and Written Opinion dated Jan. 30, 2023, directed to International Application No. PCT/IB2022/000486; 11 pages.

* cited by examiner

TENT WITH CONFIGURABLE FLUE OPENINGS

FIELD OF THE INVENTION

The invention generally relates to structures having a ridge with configurable flue openings.

BACKGROUND

Camping and other outdoor activities have surged in popularity recently, especially during the COVID-19 pandemic as people have sought socially distant vacation and travel options. At the same time, people have become accustomed to various creature comforts and are no longer satisfied with the spartan campsites, tents, and other camping structures historically available to consumers. Furthermore, to increase the usefulness and value of tents and other temporary structures, increased versatility and ease of changing configurations are key factors so that a single structure can be easily optimized for different layouts and purposes.

SUMMARY

Systems and methods of the invention include tents and other structures having various improvements to render temporary structures such as tents more comfortable and to generally improve outdoor experiences such as camping. Retractable panels are described herein that may be used as walls or roof panels for tents or other temporary structures. The retractable panels can be constructed of any flexible material including water-resistant materials and even mesh or screen material and may include two or more layers of independently retractable panels to allow for differing levels of light, weather, and insect protection. The panels described herein can allow for easy transition from enclosed to open space using simple mechanisms relying on gravity and friction to permit a single user to roll and stow panel material unassisted. Additionally, the use of simple mechanisms without the need for synthetic or modern materials and machines allows tents or other temporary structures of the invention to maintain a rustic appearance and not detract from the natural experience many users may be seeking in the outdoors.

In certain embodiments, configurable roof beams or ridges may be included capable of accommodating a number of flues for various cooking and heating apparatuses allowing users to heat and prepare food within tents and other structures. The ridge can include one or more beams which may be rotated along their width or length to change the position of a flue opening therein or even eliminate the opening entirely. A structure's ridge or other roof beam may include any number of beams allowing for a variety of different flue placements and numbers.

Aspects of the invention can include a roof system comprising one or more rotatable beams having one or more openings therethrough and one or more troughs sized and shaped to receive the one or more rotatable beams. The one or more rotatable beams can be operable to rotate between an open position and a closed position, wherein the open position aligns the one or more openings to permit passage of a flue or vent from an interior of a structure to an exterior of the structure and wherein the closed position aligns the one or more openings such that there is no opening between the interior the exterior of the structure through the one or more rotatable beams.

At least one of the one or more openings can be positioned closer to a proximal end than a distal end thereof such that location of the one or more openings relative to the structure, in the open position, is changed by switching the orientation of the proximal and distal ends within the one or more troughs. The one or more rotatable beams may be cylindrical in shape. In certain embodiments, the one or more rotatable beams may be shaped in a prism comprising two bases and at least three sides. The one or more rotatable beams can be cuboid in shape.

In some embodiments, the one or more troughs can comprise a gasket operable to provide a seal between the one or more troughs and the one or more rotatable beams when placed therein. The one or more openings may comprise a sealing member operable to provide a seal between the one or more rotatable beams and a flue or vent passing through the one or more openings therein. In various embodiments, the one or more rotatable beams can comprise wood, metal, composite materials, and/or plastic.

The one or more rotatable beams and one or more troughs may be positioned along a roof ridge. Roof systems of the invention may include three rotatable beams and three troughs positioned end-to-end lengthwise along the roof ridge. Each of the one or more rotatable beams can comprise a plurality of openings. In some embodiments, the plurality of openings may not pass through the one or more rotatable beams along parallel axes. The one or more troughs may be sized, shaped, and operable to receive the one or more rotatable beams from above. In some embodiments, the one or more troughs can be sized, shaped, and operable to receive the one or more rotatable beams by sliding the one or more rotatable beams into the one or more troughs lengthwise. The one or more rotatable beams can comprise a gasket along their distal or proximal ends and operable to provide a seal between the one or more rotatable beams when they are positioned end-to-end within the one or more troughs.

Aspects of the invention can include a retractable panel comprising a flexible material comprising an upper edge and a lower edge and fixed to a support at its upper edge, a rigid portion coupled to the lower edge, and one or more lines fixed to a point on a first side of the flexible material near the upper edge, said one or more lines running under the rigid portion, and through one or more pulleys on a second side of the flexible material opposite the first side and near the upper edge such that the one or more lines contact the flexible material at the rigid portion but are not secured thereto. The one or more lines, upon being pulled through the pulley, may be operable to roll the rigid portion thereby rolling the flexible material at its lower edge and raising it toward the upper edge. The support may be a roof beam of a structure. The unrolled flexible material can form a roof panel of the structure. The unrolled lower edge may be positioned near a top of a wall of the structure In certain embodiments, the first side of the flexible material can face an area outside of the structure. In some embodiments, the second side of the flexible material may face an area outside of the structure. The unrolled flexible material may form a wall with its unrolled lower edge positioned near ground. In various embodiments, the rigid portion may comprise one or more members extending from its proximal and distal ends beyond a border of the flexible material, the one or more members operable to fit inside one or more complimentary channels within support beams positioned on either side of the flexible material running from the lower edge to the upper edge when the flexible material is unrolled, the complimentary channels operable to resist movement of the rigid portion and flexible material toward the first side or the second side.

Retractable panels of the invention may further comprise a locking mechanism for securing the one or more lines to hold the flexible material in a rolled position. The locking mechanism can comprise a ratchet and pawl. The locking mechanism may comprise a tie off cleat. Panels of the invention may include a motor operable to pull the one or more lines through the pulley. Where the non-fixed end of the line is on the outside of the structure, the line may pass, via pulleys or otherwise, over the top of the fixed upper edge of the flexible material and back into the interior of the structure. In certain embodiments, the line may pass through a grommet into the interior of the structure to provide a seal around the line while still permitting movement of the line therethrough.

In various embodiments, the flexible material may be water resistant, may comprise a mesh, may be mosquito netting, and/or may comprise canvas. The flexible material may comprise a joining mechanism along its one or more vertical edges, said joining mechanism operable to join the one or more vertical edge to one or more vertical edges of an adjacent retractable panel. The joining mechanism may be a zipper.

The rigid portion can comprise one or more teeth and the one or more lines comprise structures operable to engage the teeth and impart rotation to the rigid portion upon pulling the line through the pulley. The rigid portion may comprise one or more sprockets and the one or more lines comprise a chain. The first or second side of the flexible material may, in certain embodiments, face a first or second side of an additional retractable panel, operable to be raised or lowered independent of the retractable panel.

In certain aspects, the invention may include structures, such as tents, comprising various combinations of retractable panels and rotatable beams and troughs for configurable flue openings. In some embodiments, the upper edge of the flexible material of a retractable roof panel may be fixed to a trough positioned as ridge of the roof.

BRIEF DESCRIPTION OF THE DRAWINGS

FIG. 11A shows a side perspective while FIG. 11B shows a bottom perspective view.

DETAILED DESCRIPTION

Systems and methods of the invention relate to improving the usability of structures, especially temporary outdoor structures such as framed tents. Described herein are configurable roof beams or ridges and troughs for receiving them. By rotating the beams in different directions, a user can change the number and/or position of openings in the roof to accommodate various numbers and locations of heating, cooling, cooking, or other apparatuses requiring a flue, exhaust, or other ventilation. The adaptable nature of the roof systems allows for a single structure to be relatively quickly and easily reconfigured for different layouts and uses. Retractable panels are also described that allow for simple, manual or automated opening and closing to transition between indoor and outdoor space. The described panels can be used as wall and/or roof panels in tents or other structures. They can use a simple system of lines and pulleys relying on gravity, friction, and the weight of the flexible panels to allow a user to roll or unroll the flexible panels about a rigid lower portion to raise/open or lower/close the panel.

Figure 5:
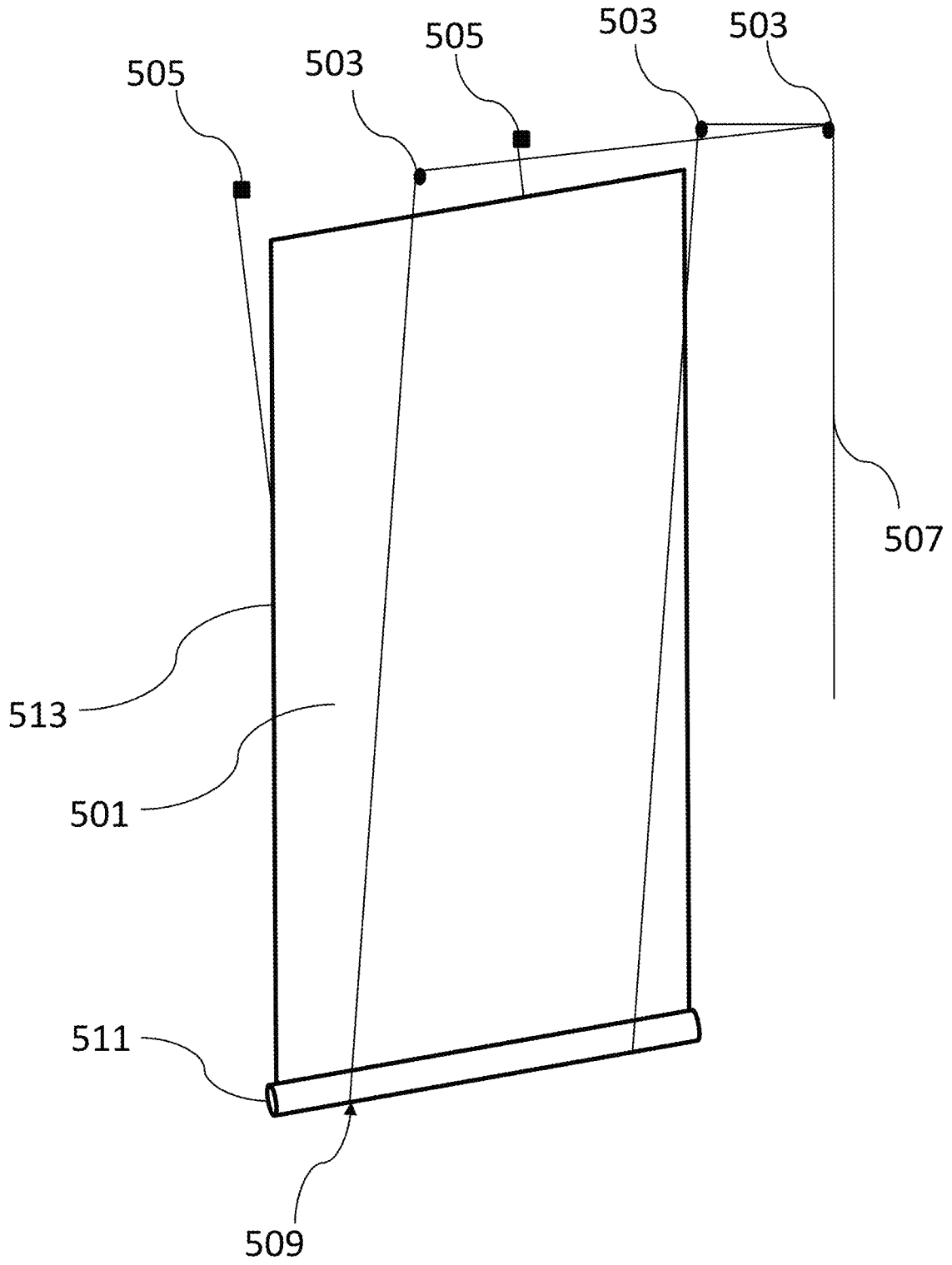
FIG. 5 shows an exemplary retractable panel.

Exemplary retractable panels of the invention are shown in FIG. 5. The panels consist of a flexible material 501 having an upper edge and a lower edge. The upper edge can be secured to a beam or other solid support of a temporary structure such as a tent. The lower edge can include a rigid portion 511 coupled thereto. The weight of the rigid portion 511 and/or the flexible material 501 itself is preferably such that, when suspended from the upper edge, the flexible material 501 will hang down and generally resist inward, outward, or twisting movement in response to wind or the like. In various embodiments, especially where the retractable panel is used as a roof panel, the structure may include additional supports framing the opening covered by the flexible material 501 such that the supports prevent the rigid portion 511 and the flexible material 501 from falling through the opening when the retractable panel is deployed in a orientation other than vertical (e.g. as a wall panel).

The panel may include one or more lines 507 that are fixed to a point 505 on one side of the flexible material 501. The lines 507 can then run down one side of the flexible material 501, under the rigid portion 511 and up the other side of the flexible material 501. The lines 507 contact the rigid portion 511 and/or the flexible material 501 at a point 509 where the lines 507 pass thereunder. The lines 507 then run up the other side of the flexible material 501 to a point near the upper edge where they can interact with a powered or manual spool or crank or be redirected via one or more pulleys 503 as shown in FIG. 5. In either instance, a user (via manual interaction or powered assistance of a motor) imparts a force drawing upward on the lines 507 toward the pulleys 503 or other point near the upper edge of the flexible material 501 and on the opposite side thereof from the fixed point 505 the lines 507 originate from. The force (via direct upward motion or motion in another direction redirected via pulleys 503) acts to shorten the length of the lines 507 between points 505 and 503, thereby drawing the lower edge of the flexible material 501 and the rigid portion 511 against gravity and upward toward the upper edge of the flexible material 501.

The lines 507 are preferably not coupled to the flexible material 501 or rigid portion 511. Instead, the weight of the flexible material 501 and/or the rigid portion 511 along with friction between the flexible material 501 and/or the rigid portion 511 and the one or more lines 507 at point 509 impart a rotational motion to the flexible material 501 as the lines 507 are pulled through pulleys 503. Because the rigid portion 511 and bottom edge of the flexible material 501 is rotated as they are pulled upward toward the upper edge, the flexible material 501 is rolled up upon itself, neatly managing excess material. Upon releasing the lines 507 through the pulleys 503, the weight of the flexible material 501 and/or the rigid portion 511 act via gravity to unroll the flexible material 501, thereby lowering the panel to cover an opening in the structure (e.g., a wall or roof). The rigid portion 511 can preferably be cylindrical or have a multifaceted cross section to encourage rotation as the lines 507 are pulled along the interaction point 509. While the rigid portion 511 is referred to as such herein, it need not be completely rigid. Some amount of flexibility can be tolerated. In certain embodiments, the rigid portion 511 may be a separate member secured to the flexible material 501 via adhesive or fasteners such as screws, rivets or thread (e.g., being sewn into a loop of the flexible material 501). In some embodiments, the rigid portion 511 may simply comprise the flexible material 501 itself which has been treated at its lower edge to reduce its flexibility (e.g., treated with an epoxy or hardening chemical capable of coating of soaking onto the flexible material 501).

Figure 8:
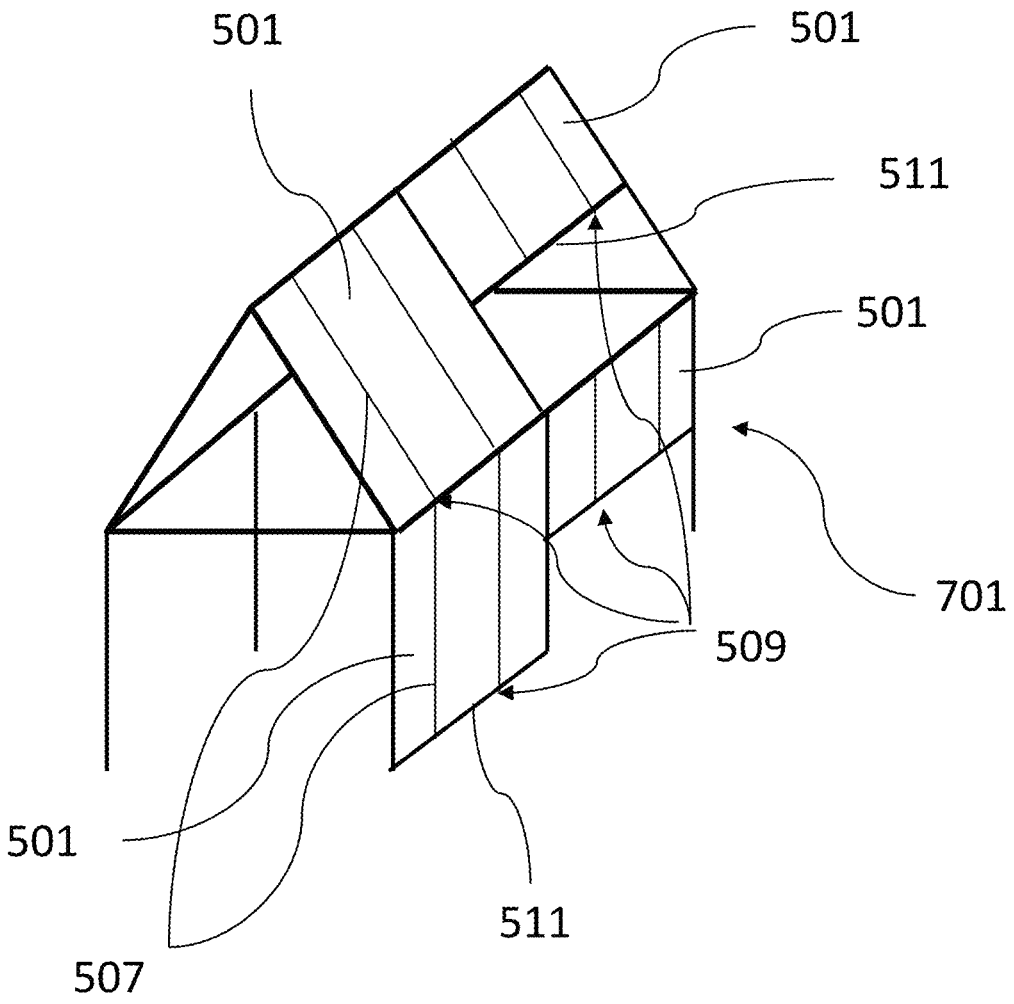
FIG. 8 shows an exemplary tent frame structure using retractable roof and wall panels.

FIG. 8 shows an exemplary structure 701 such as a tent using retractable panels of the invention. As shown, flexible material 501 may be deployed over an otherwise open frame to form roof or wall panels. All roof and/or wall panels of the structure 701 may be made up of retractable panels or only some portion thereof may be with traditional fixed walls or roof panels making up the difference. Each panel can be retracted independently or, using pulley systems or combinations of motors, retracted in groups. The panels can be rolled up to completely open or close the frame opening thereunder or can be rolled partway to provide infinite variability in outdoor exposure. Preferably, roof panels are installed on a roof frame having at least some level of pitch as opposed to a horizontal roof. Adding pitch can aid in water shedding in inclement weather as well as allowing the roof panel to use gravitational forces to operate as discussed above.

In the case of horizontal applications or others where gravity is insufficient, an alternative force can be applied to resist the rolling of the flexible material upon application of force to the lines. For example, counterweights can be attached to the rigid portion (e.g., on rotatable extensions beyond the side edges of the flexible material so as not to interfere with retraction thereof) via lines and pulleys to redirect gravitational forces. In other examples, springs may be attached to the rigid portion instead of counterweights to impart a resistive force.

In the case of roof panels as shown in FIG. 8 or other non-vertical applications, it may be preferable to have the fixed point 505 located on the upper side of the non-vertical flexible material 501 so that retraction of the panel does not involve rolling the flexible material 501 under itself which could interfere with the process.

The flexible material can be made of any number of materials with a variety of properties to accomplish different goals. For example, the flexible material may comprise a transparent plastic or other translucent or transparent material to allow for varying amounts of light to pass therethrough while still maintaining a barrier to rain, wind, or other undesirable weather conditions. Such materials may be particularly desirable for roof panels to allow direct sunlight. In various embodiments, the materials may include some amount of UV protection to protect individuals and objects within the tent or other structure from UV damage.

In certain embodiments, the flexible material may comprise a water resistant or waterproof fabric such as a waxed or oiled canvas or nylon or a synthetic material such as GORE-TEX available from W.L. Gore & Associates, Inc. (Newark, Del.). The flexible material may comprise a mesh or netting to permit light and air to pass therethrough while preventing insects from passing.

Figure 9:
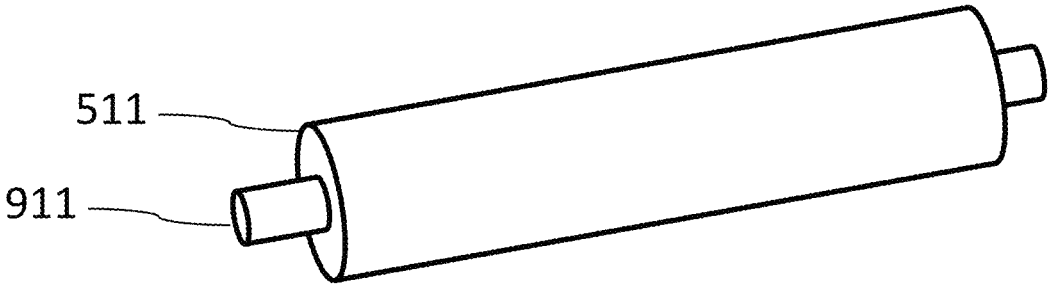
FIG. 9 shows an exemplary rigid portion of a retractable panel having extending member on its ends.
Figure 10:
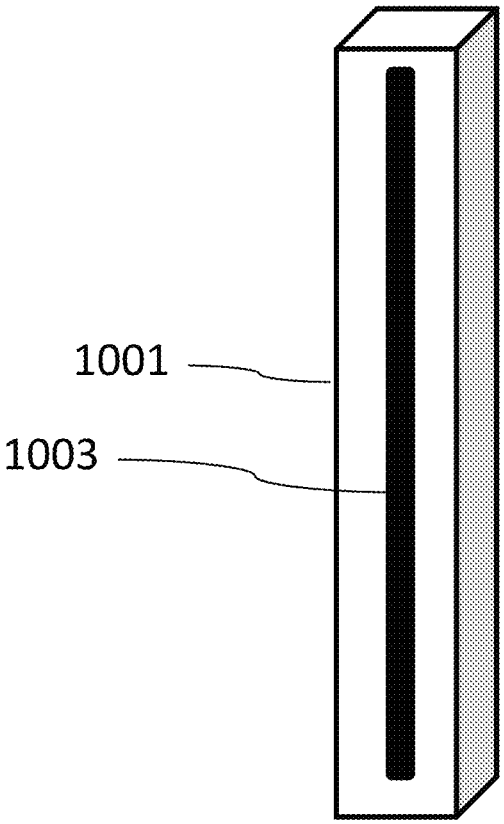
FIG. 10 shows an exemplary guide track for receiving the extending member of the rigid portion of a retractable panel therein.

In various embodiments, a structure using retractable panels (e.g., the tent structure shown in FIG. 8) may include support beams and/or posts defining openings that the retractable panels operate to cover and uncover. The retractable panels can be wider than the opening such that the edges cover and/or rest upon the support beams or posts. In some embodiments, the retractable panels may be narrower than the openings. In such embodiments, the panels and/or support beams or posts may include features operable to locate the panel with respect to the structure. For example, the rigid portion 511 of a retractable panel may include one or more members 911, tabs, extensions, posts, or other features extending from its proximal and/or distal ends as shown in FIG. 9. As shown in FIG. 10, a support beam or post 1001 running along the side of the retractable panel and forming a solid portion of the structure may include a channel 1003 operable to receive the member 911 and thereby locate and guide the rigid portion 511 as the retractable panel is rolled or unrolled. Such a configuration can help the retractable panel resist inward, outward, or twisting movement relative to the structure (e.g., in response to wind).

In certain embodiments, more than one retractable panel may be layered and independently operable. For example, an opaque panel for blocking light, a transparent plastic panel for blocking wind and/or rain but permitting light passage, and a mesh panel for permitting airflow but preventing insect passage may be layered so a user can independently regulate light, air, insect, and weather protection within the structure by independently raising and lowering various layers.

In order to maximize weather and/or insect protection within the structure, the panels may include joining mechanism operable to join and/or seal the side, upper, and/or lower edge of the flexible material of a retractable panel to another retractable panel, a support beam, or a floor or ceiling member. For example, two adjacent panels may include complimentary zipper portions along their adjacent side edges. When both panels are lowered, the complimentary zipper portions may be zippered together to form a uniform barrier between the inside and outside of the structure and prevent gaps therebetween through which weather and/or insects could penetrate the structure. Should a user with to raise one of the panels, they would need only unzip the edges and adjust the height of the panel(s) as discussed above.

As mentioned, lines can be operated manually or automatically by pulling by hand or winding via a powered motor. A motor may be electric, hydraulic, or otherwise powered and can operate a rotating drum around which the line can be wound, thereby drawing the line toward the drum. The force can be applied to the line at the desired draw point, in the direction of retraction and near the upper edge of the flexible material or can be remotely located with motion translated via pulleys to a point near the upper edge of the flexible material. Manual operation can rely simply on hand pulling of the lines or may use a wench and/or crank or other device to assist. The system may include a locking mechanism to lock the line, and therefore the flexible material, at a desired length/retracted height. Such a mechanism may be a simple as a tie off or cam cleat or may include a ratchet and pawl to provide defined increments/positions for raised or lowered panels.

Figure 6:
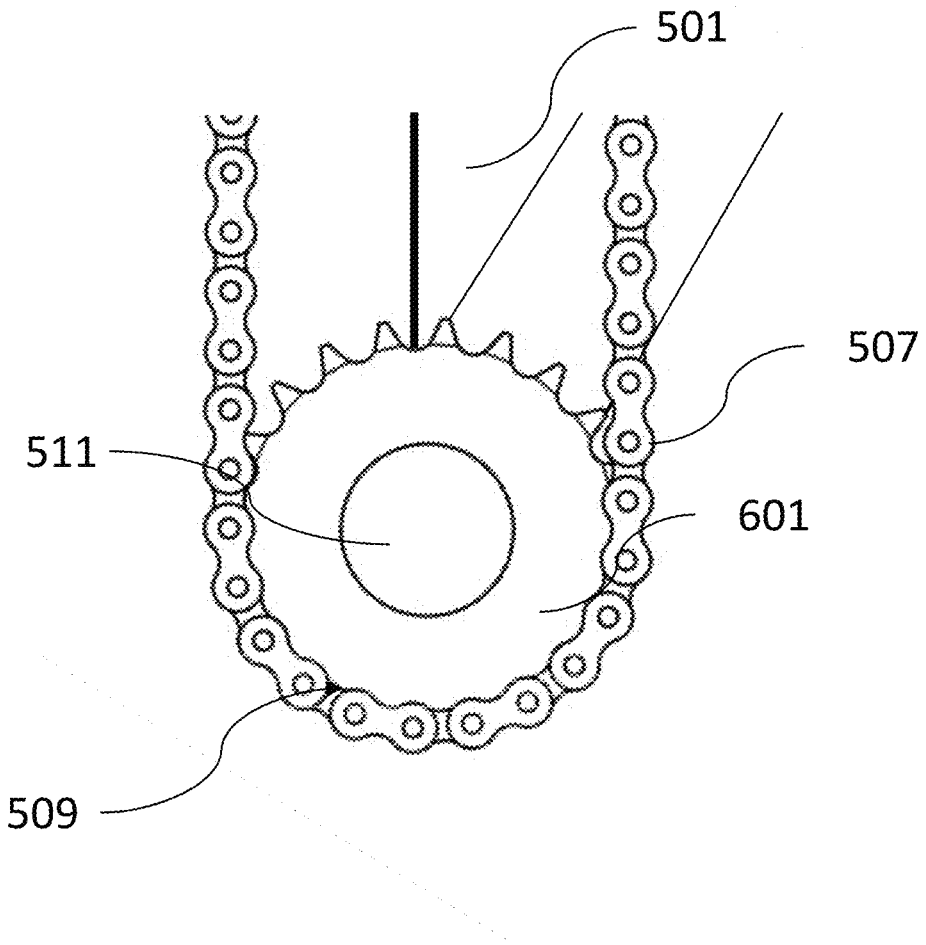
FIG. 6 shows an exemplary chain and sprocket interface at a rigid portion of a retractable panel.

In certain embodiments, the rotational force imparted by the line on the rigid portion/lower edge of the flexible material can rely on more than simple friction between the materials. For example, the rigid portion 511 may include one or more teeth to interact with the line 507 passing thereover and provide purchase for the line 507. The line 507 may in turn comprise features operable to engage the teeth as it passes thereover. As shown in FIG. 6, the rigid portion 511 may include one or more sprockets 601 and the line may include a chain 507 having features complimentary to the teeth of the sprocket 601. At the point 509 of interaction between the line 507 (chain) and sprocket 601, the features and teeth interact to maximize the transfer of rotational motion from the line 507 to the rigid portion 511 to effectively roll the flexible material 501 up. The sprocket 601 may be located at the end of the rigid portion 511, beyond the side edge of the flexible material 501 so as not to interfere with rolling thereof.

Figure 1:
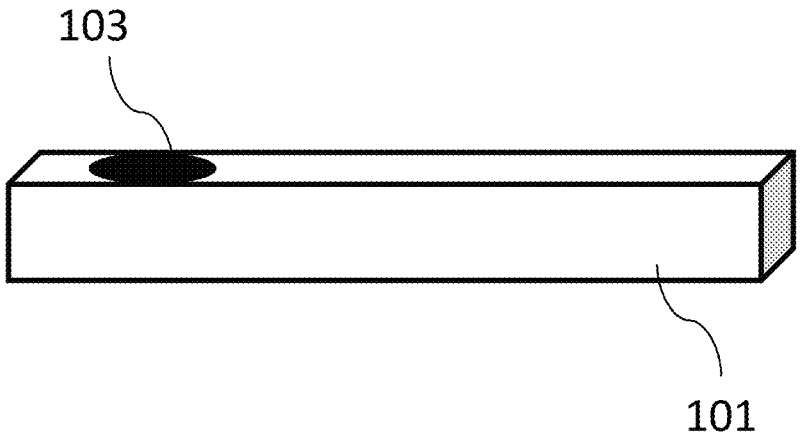
FIG. 1 shows an exemplary roof beam with configurable flue or vent openings in an open configuration.
Figure 7:
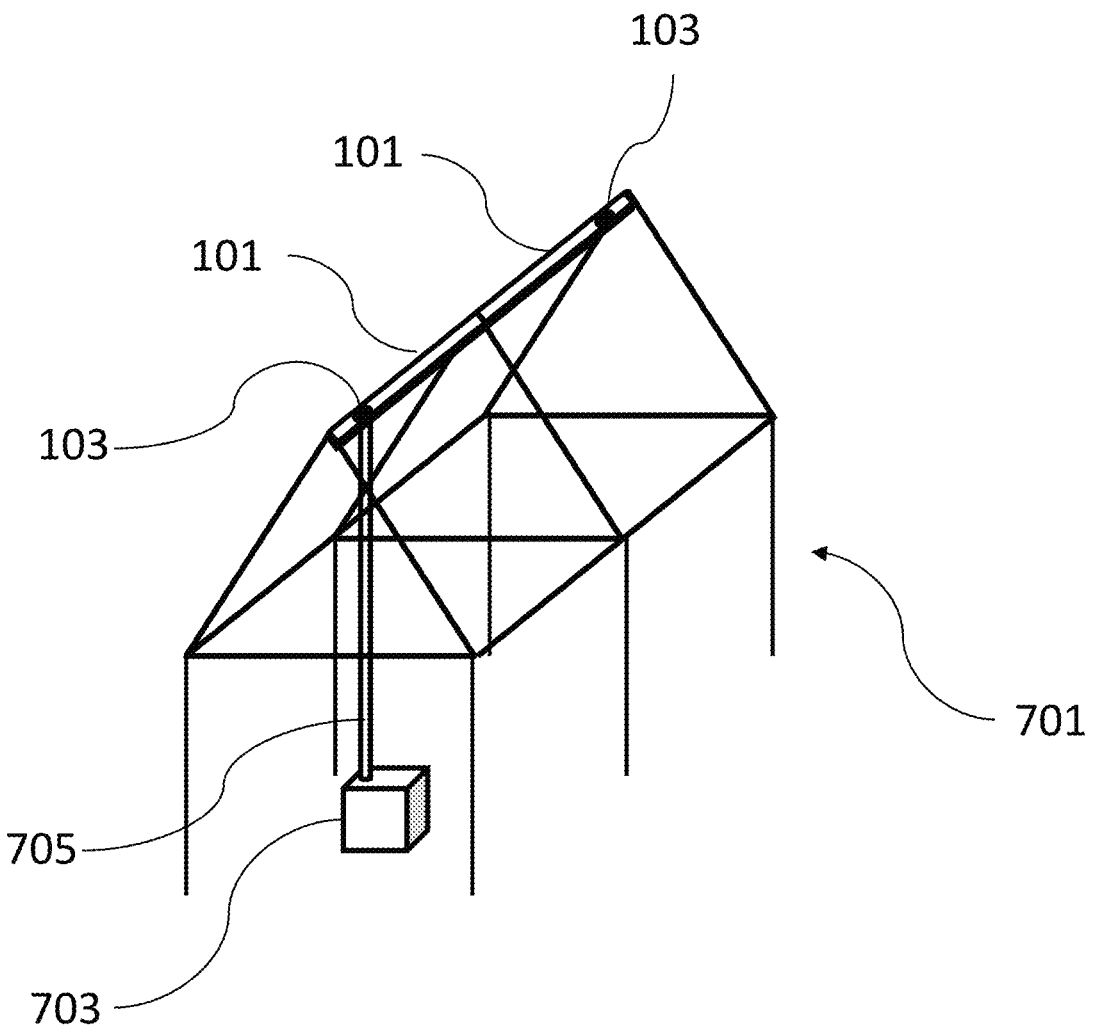
FIG. 7 shows an exemplary tent frame structure using roof beams with configurable flue or vent openings.

In order to allow for the use of heating and cooking apparatuses within structures and to provide the ability to easily configure a space for different numbers and layouts of such apparatuses (or other devices requiring external ventilation), roof members with configurable openings are provided herein. Roof systems of the invention may include rotatable roof beams having one or more openings therethrough. FIG. 1 illustrates such as rotatable beam 101 with an opening 103. A structure 701 as shown in FIG. 7, may include troughs sized and shaped to receive such rotatable beams 101. The troughs may be part of the structure 701 and may be incorporated into its roof structure for example in a ridge.

Figure 2:
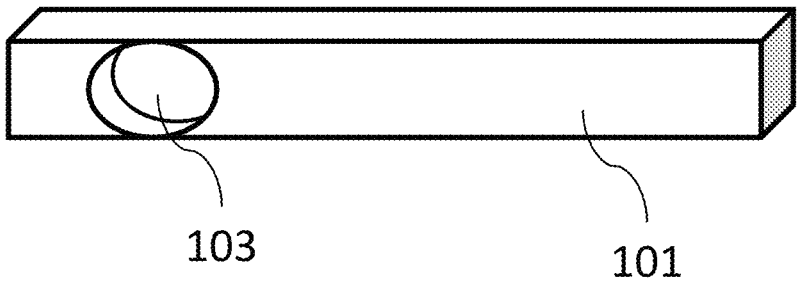
FIG. 2 shows an exemplary roof beam with configurable flue or vent openings in a closed configuration.

The rotatable beam 101 can be rotated in the trough between an open position (FIG. 1) wherein the opening 103 is positioned in a first orientation that aligns the opening 103 to permit passage of a flue or vent 705 from an interior of a structure to an exterior of the structure and a closed position (FIG. 2) in which the opening 103 is positioned in a second orientation that aligns the opening 103 such that there is no opening between the interior the exterior of the structure through the rotatable beam 101. In certain embodiments, the trough may include sides that cover the opening 103 when the rotatable beam 101 is rotated into the closed position. The flue or vent 705 can, for example, be attached to a various cooking and/or heating appliances 703 to be operated inside the structure including those described in U.S. Pat. No. 11,051,655, incorporated herein by reference. Flues for heating or cooking apparatuses having open flames and producing smoke (e.g, a wood burning stove) are preferably as close to vertical as possible to maximize smoke evacuation.

Rotatable beams 101 can have one, two, three, four, or more openings 103 therethrough. In certain embodiments, the rotatable beam 101 may have openings 103 in different positions along the length of the beam 101 wherein the openings 103 pass through rotatable beam 101 at different angles. In such embodiments, rotating the beam 101 may alternatively open one or the other of the openings 103 or may still include a closed position where neither of the openings 103 are aligned between the interior and exterior of the structure.

Figure 3:
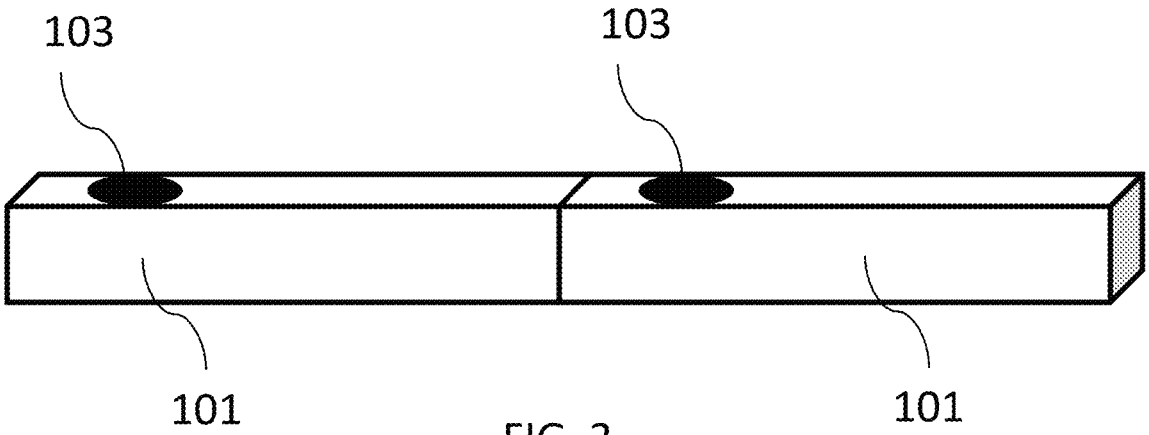
FIG. 3 shows an exemplary roof ridge with configurable flue or vent openings in a first position.
Figure 4:
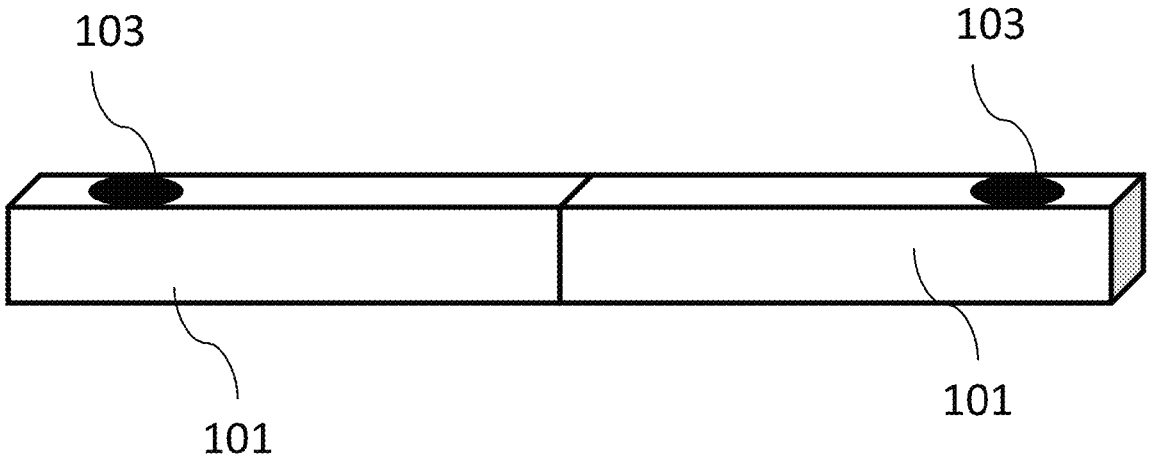
FIG. 4 shows an exemplary roof ridge with configurable flue or vent openings in a second position.

In certain embodiments, a beam 101 may have an opening 103 positioned closer to one end of the beam 101 than the other. The position of the openings 103 relative to the structure can accordingly be changed by switching the orientation of the ends of the beam 101 within the trough. FIGS. 3 and 4 illustrate this feature. FIG. 3 shows the beams 101 in a first orientation with two openings 103 therethrough. FIG. 4 shows the beams 101 where one has been positioned with its ends swapped to change the location of one of the openings 103 relative to the structure. Practically, doing this allows for a user to change the corresponding position of vented apparatuses in the structure below.

A structure may include multiple troughs or single troughs long enough to receive multiple beams placed end-to-end (as shown in FIGS. 3 and 4) thereby exponentially increasing the number of available configurations by opening, closing, or repositioning the openings 103 in each of multiple beams 101.

Rotatable beams of the invention may have cross-sections in a variety of shapes which may correspond to the number of different opening locations therethrough and/or to ease rotation. For example, in certain embodiments, the rotatable beams may be cylindrical in shape such that the beam can be readily rotated between open and closed positions or different openings without removal from the trough. In some embodiments, the rotatable beams can be shaped in a prism comprising two bases and at least three sides or a cuboid shape as shown in FIGS. 1-4. For example, the beam may have an octagonal cross-sectional shape (e.g., two octagonal bases and eight sides) where six of the eight sides have an opening passing therethrough (for three openings) while two opposing sides do not (providing a closed orientation). The three openings can be placed at different locations along the length of the beam to provide versatility in flue placement. In other embodiments, two opposing sides of the beam may have one opening passing therethrough while two other opposing sides of the same beam have multiple openings therethrough (e.g., two). A user could thereby alter not only the location of flue openings but the number of flue openings by rotating a single beam.

The troughs and/or beams preferably comprise a gasket or other liner material at the interface of the beam and the trough such that the weight of the beam, when placed in the trough, provides a seal therebetween. Because the beams and troughs form a portion of the structure roof, such gasket and/or seals can help prevent undesired weather exposure and maintain the designated opening in the beam as the only open passage between the interior and exterior of the structure through the roof. Similarly, the openings may comprise a grommet or gasket material sized to receive and form a seal around a flue or vent passing therethrough to resist or prevent water passing into the structure between the outside of the vent and the walls of the opening. Where multiple beams are positioned end-to-end in a single trough as shown in FIGS. 3 and 4, additional gaskets or other sealing members may be included either in the troughs or on the beams to aid in sealing at contact points between the ends of the beams.

Beams may be constructed of a variety of materials including wood, metal, plastics, and/or composites depending on application. For example, wood or wood appearance beams may be desirable to maintain a rustic appearance for a natural tent structure. Alternatively, an aluminum or carbon fiber beam may be desirable for weight considerations in which the tent is being transported to and constructed in a remote location.

Troughs may be sized and shaped to receive a beam from above. For example, a beam could be dropped into a U-shaped trough having an opening at the top from above. Alternatively, a trough may have an opening at its top that is sized enough to permit passage of a flue but the opening may be smaller than the width of the beam to aid in beam retention and sealing. In such instances, the trough may include an open end such that beams can be slid into the trough lengthwise. In certain embodiments, a trough may include a substantially closed top having one or more openings therethrough sized approximately equal to the openings in the beam. In such embodiments, by sliding the beam lengthwise along the trough, the opening in the beam could be aligned with openings in the trough at different positions to provide a flue pass-through. When the openings in the beam and the trough are not aligned, the beam would act to close the trough opening, keeping out weather.

Figure 11A:
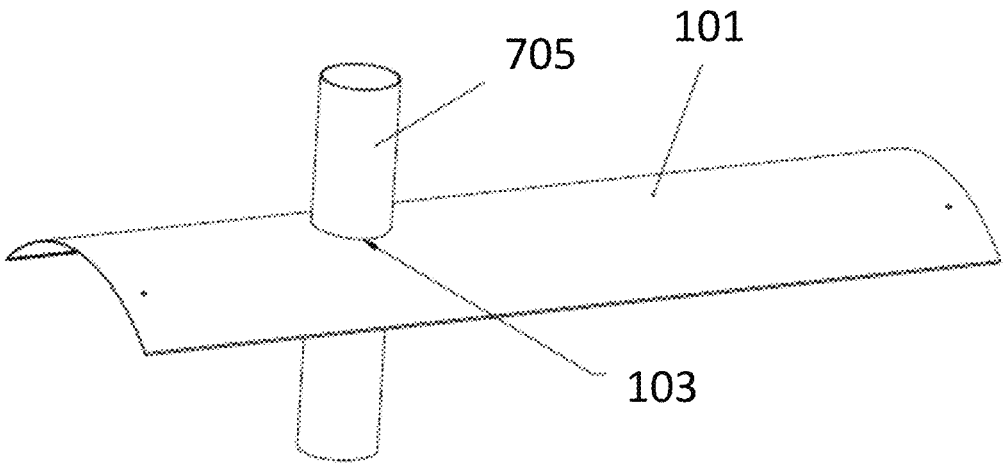
FIGS. 11A and 11B show different views of a configurable roof beam according to certain embodiments.
Figure 11B:
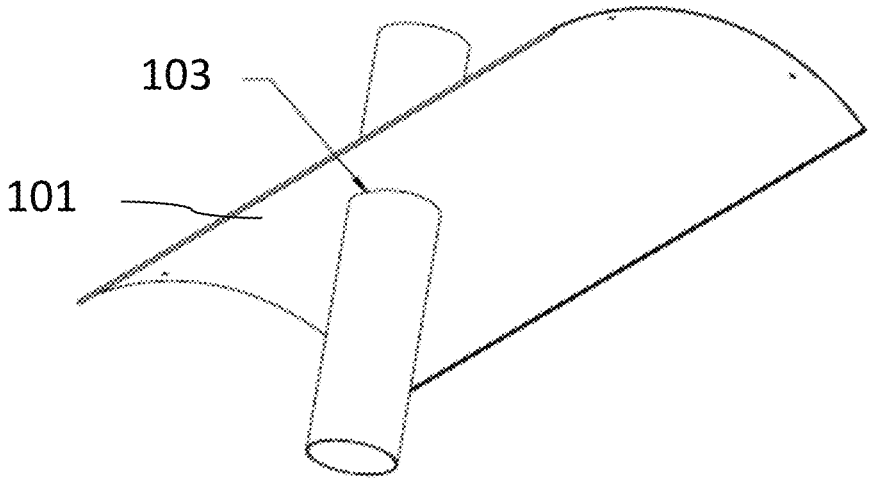
Figure 12:
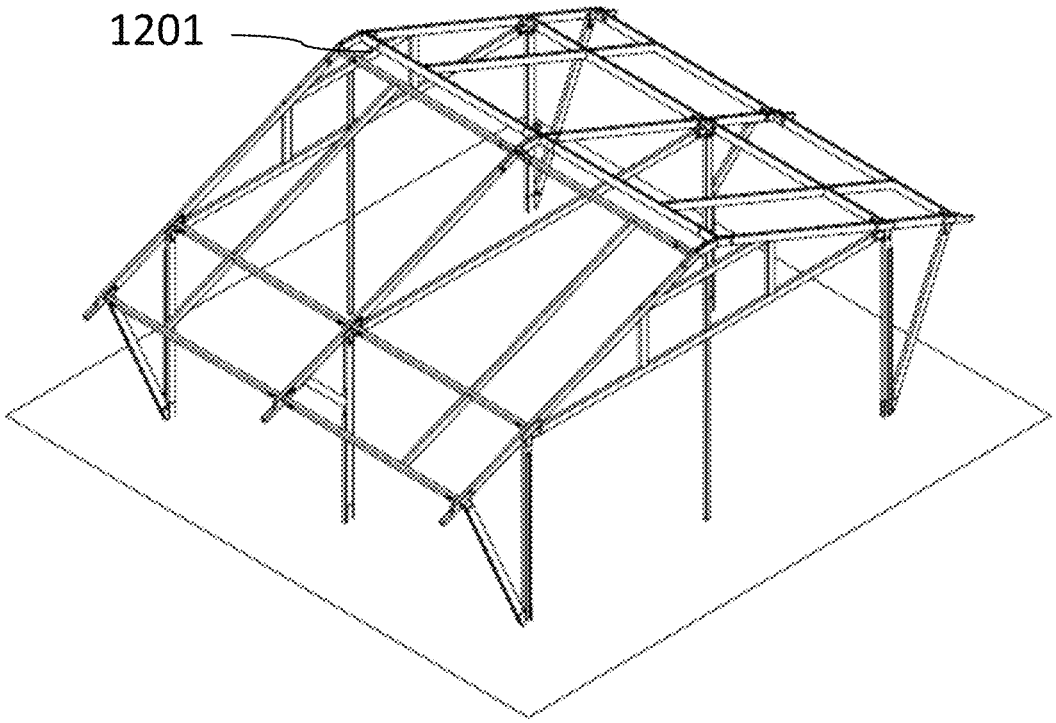
FIG. 12 shows an exemplary structure with troughs for receiving the roof beam of FIGS. 11A and 11B.
Figure 13:
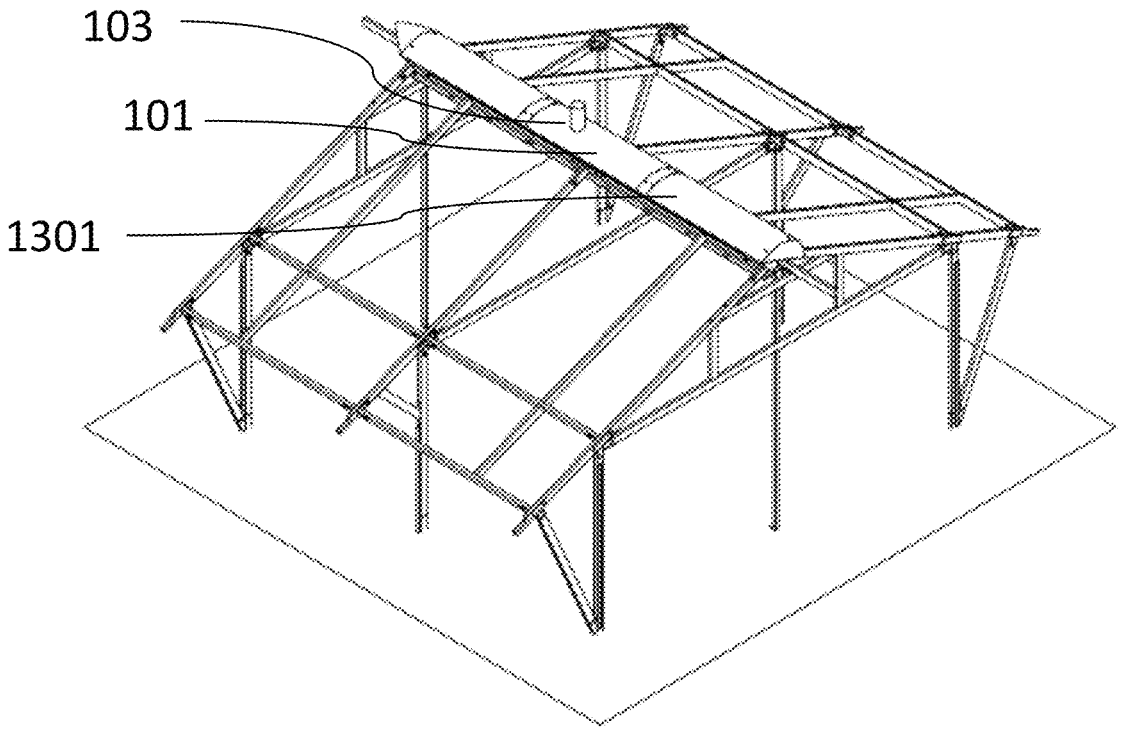
FIG. 13 shows an exemplary structure with the roof beam of FIGS. 11A and 11B positioned thereon.

In certain aspects, roof systems of the invention may include a configurable roof cap or beam 101 with an opening 103 therethrough as shown in FIGS. 11A and 11B. As shown in FIGS. 12 and 13, the cap or beam 101 may have an upper portion that is wider than the trough 1201 that accepts the flue 705 or vent such that the cap or beam's upper portion extends over the trough 1201. The cap or beam 101 can thereby cover any gap between the cap and beam 101 and the trough 1201 or other opening in the roof structure and, by overlaying the roof panels, direct rain down the pitched roof panels and provide rain and weather protection. The trough 1201 may be sized and shaped to accept a vent or flue 705 passing therethrough but configured such that the actual cap or beam 101 rests on top of and covering the trough 1201 as shown in FIGS. 12 and 13. The cap or beam 101 may have a curved shape along its width to aid in directing water from the roof peak onto the pitched roof panels on either side.

The roof cap Roof caps having no openings 1301 can be used in conjunction with the roof cap or beam 101 having an opening 103 to eliminate or relocate the flue 705 to accommodate different arrangements of vented apparatuses in the structure below. In certain embodiments, the opening 103 may have a portion of vent or flue 705 attached therethrough as shown in FIG. 11A. In such embodiments, the portion of vent or flue 705 can be permanently fixed and/or sealed to the edges of the opening 103 (e.g., via welding) and may be sized to a standard size to accept coupling with exhaust venting or other tubing via a tight slide fit for example to ease set up and breakdown of the structure. The portion of vent or flue 705 extending above the cap or beam 101 can be sized to accept a friction fit vent cap or be otherwise configured to have a vent cap attached thereto (e.g., via screws or other fasteners) or may have a vent cap pre-coupled thereto.

INCORPORATION BY REFERENCE

References and citations to other documents, such as patents, patent applications, patent publications, journals, books, papers, web contents, have been made throughout this disclosure. All such documents are hereby incorporated herein by reference in their entirety for all purposes.

EQUIVALENTS

Various modifications of the invention and many further embodiments thereof, in addition to those shown and described herein, will become apparent to those skilled in the art from the full contents of this document, including references to the scientific and patent literature cited herein. The subject matter herein contains important information, exemplification and guidance that can be adapted to the practice of this invention in its various embodiments and equivalents thereof.

What is claimed is:

1. A roof system comprising:

one or more rotatable beams having one or more openings therethrough; and one or more troughs sized and shaped to receive the one or more rotatable beams, wherein the one or more rotatable beams are operable to rotate between an open position and a closed position, wherein the open position aligns the one or more openings to permit passage of a flue or vent from an interior of a structure to an exterior of the structure and wherein the closed position aligns the one or more openings such that there is no opening between the interior the exterior of the structure through the one or more rotatable beams.

2. The roof system of claim 1, wherein at least one of the one or more openings is positioned closer to a proximal end than a distal end thereof such that location of the one or more openings relative to the structure, in the open position, is changed by switching the orientation of the proximal and distal ends within the one or more troughs.

3. The roof system of claim 1, wherein the one or more rotatable beams are cylindrical in shape.

4. The roof system of claim 1, wherein the one or more rotatable beams are shaped in a prism comprising two bases and at least three sides.

5. The roof system of claim 4, wherein the one or more rotatable beams are cuboid in shape.

6. The roof system of claim 1, wherein the one or more troughs comprise a gasket operable to provide a seal between the one or more troughs and the one or more rotatable beams when placed therein.

7. The roof system of claim 1, wherein the one or more openings comprise a sealing member operable to provide a seal between the one or more rotatable beams and a flue or vent passing through the one or more openings therein.

8. The roof system of claim 1, wherein the one or more rotatable beams comprise wood.

9. The roof system of claim 1, wherein the one or more rotatable beams comprise metal.

10. The roof system of claim 1, wherein the one or more rotatable beams comprise a composite material.

11. The roof system of claim 1, wherein the one or more rotatable beams comprise a plastic.

12. The roof system of claim 1, wherein the one or more rotatable beams and one or more troughs are positioned along a roof ridge.

13. The roof system of claim 12 comprising three rotatable beams and three troughs positioned end-to-end lengthwise along the roof ridge.

14. The roof system of claim 1, wherein each of the one or more rotatable beams comprises a plurality of openings.

15. The roof system of claim 14, wherein the plurality of openings do not pass through the one or more rotatable beams along parallel axes.

16. The roof system of claim 1, wherein the one or more troughs are sized, shaped, and operable to receive the one or more rotatable beams from above.

17. The roof system of claim 1, wherein the one or more troughs are sized, shaped, and operable to receive the one or more rotatable beams by sliding the one or more rotatable beams into the one or more troughs lengthwise.

18. The roof system of claim 1, wherein the one or more rotatable beams comprise a gasket along their distal or proximal ends and operable to provide a seal between the one or more rotatable beams when they are positioned end-to-end within the one or more troughs.

* * * * *